US009259740B1

(12) United States Patent
Rieck

(10) Patent No.: US 9,259,740 B1
(45) Date of Patent: Feb. 16, 2016

(54) EXTENDED RIFFLE STRUCTURE FOR A DRY WASHER

(71) Applicant: Robert Rieck, Mission Viejo, CA (US)

(72) Inventor: Robert Rieck, Mission Viejo, CA (US)

( * ) Notice: Subject to any disclaimer, the term of this patent is extended or adjusted under 35 U.S.C. 154(b) by 0 days.

(21) Appl. No.: 14/121,481

(22) Filed: Sep. 10, 2014

Related U.S. Application Data

(60) Provisional application No. 61/999,196, filed on Jul. 18, 2014.

(51) Int. Cl.
*B03B 4/00* (2006.01)
*B03B 4/02* (2006.01)
*B03B 4/06* (2006.01)

(52) U.S. Cl.
CPC ... *B03B 4/00* (2013.01); *B03B 4/02* (2013.01); *B03B 4/065* (2013.01)

(58) Field of Classification Search
CPC ..... B03B 5/06; B03B 5/26; B03B 5/62; B03B 5/10; B03B 5/02; B03B 4/00; B03B 4/02; B03B 4/06; B03B 4/065; B03B 1/4654
USPC ..... 209/466, 471, 474, 477, 479, 484, 506, 209/507
See application file for complete search history.

(56) References Cited

U.S. PATENT DOCUMENTS

| | | | | | |
|---|---|---|---|---|---|
| 1,233,149 | A | * | 7/1917 | Wall | 209/441 |
| 4,615,797 | A | * | 10/1986 | Keene | 209/131 |
| 4,793,918 | A | * | 12/1988 | Thomas | 209/467 |
| 5,087,351 | A | * | 2/1992 | Valentine, Sr. | 209/20 |

* cited by examiner

*Primary Examiner* — David H Bollinger
(74) *Attorney, Agent, or Firm* — I. Michael Bak-Boychuk

(57) ABSTRACT

A generally elastic riffle assembly useful with a dry washer is provided with a frame that is receivable within the washer opening through which the mined particulates descend while the washer is agitated to separate the denser particulates and a set of inclined transverse riffles aligned across the frame to form wedge shaped transverse cavities in which the descending particulates are collected. Each of the riffles further include a plurality of generally vertical posts attached to their elevated edges which assist in the separation of the particulate flow and in setting off of the various modes of elastic motion of their corresponding riffle.

15 Claims, 4 Drawing Sheets

EXTENDED RIFFLE STRUCTURE FOR A DRY WASHER

REFERENCE TO RELATED APPLICATIONS

The benefit of the earlier filing date of U.S. Provisional Application 61/999,196 filed on Jul. 18, 2014 is claimed for all matter disclosed herein.

STATEMENT CONCERNING GOVERNMENT INTEREST

None

BACKGROUND OF THE INVENTION

1. Field of the Invention

The present invention relates to air driven structures useful in the recovery of precious ore deposits from ground formations located in arid sites, commonly referred to as dry washers, and more particularly to improvements in the agitation mechanisms thereof to promote concentration of ore bearing particulates and their retention within structures deployed in a dry washer to assist in their recovery.

2. Description of the Prior Art

Both the natural accumulation processes of precious metal deposits, like silver or gold, and also their eventual mining and collection, rely on the unique attributes thereof such as a high specific gravity, low melting point and/or limited chemical reactivity, with their high relative density providing the primary selection and concentration mechanism in low cost, remotely located, placer mining. The familiar image of a prospector panning on the banks of a remote stream is therefore symbolic of gold prospecting, often displayed in exotic, well irrigated settings surrounded by bountiful vegetation and animal life.

While perhaps there once were such verdant settings in the distant past where gold may have been found, at this time the offensive aspects of aggressive mining hare produced a multitude of regulatory constraints that then combined with a landscape already depleted, relegating most current mining activity to very remote, infertile, barren locations irrigated by few, or no local water flows. Instead, the current low-investment mining efforts have all shifted to marginal, arid and otherwise useless sites that are best worked by dry washer processes, sometimes referred to as dry placer mining, as exemplified in U.S. Pat. No. 1,701,624 to Lide; U.S. Pat. No. 3,773,174 to Stimpel; U.S. Pat. No. 4,451,357 to LaVigne; U.S. Pat. No. 4,615,797 to Keene; and many others.

Generally, these prior art dry washers each include some form of a classifying hopper at theirs inputs each provided with a classifying screen onto which the prospected local particulates are shoveled to then pass their smaller sized ones onto its smooth, inclined bottom surface to slide down into an inclined dry washer chute, or dry sluice, that includes a smooth bottom surface spaced below a fibrous mat that itself is supported on a perforated, air-permeable diffuser panel. A pumped current of air is then conveyed through this smooth bottom surface of the chute from below, either directly from an attached air pump, or by way of conveying channels, to ventilate the fibrous mat with the particulates collected therein, with the pumping mechanism and/or its air flow turbulence imparting agitation to the assembly that promotes the descent of the higher density particulates into and/or through the mat to be thereafter collected in a collection vessel.

Of course, fluid flow mechanisms similar to those used in water flows through a sluice assembly are also applicable in an air driven process and various riffle structures are utilized to promote particulate propagation into and through the fibrous mat. Significantly, however, the fluid dynamic forces associated with moving air are substantially less intense than those of water and the use of a dry washer is therefore more dependent on the efficient use of energy to drive the agitating movements through its structure to promote particulate collisions and consequent fractioning into particulates that have surface to mass ratios that are responsive to aerodynamic flows. This fractioning process invariably entails large parasitic frictional losses as the aggregate is moved around on the dry washer surfaces, with these same high friction levels then damping the several modes of elastic motion in the dry washer structure itself. Thus, like in the familiar engineering school experiment where an elastic structure on a shaker table will quickly display its node lines when just lightly sprinkled with sand, when the sand load is excessive its damping fully submerges all definition of the elastic modes and added resonant structures that are above the sand layers may be required.

Mechanisms that limit these inherent deficits of the dry placer mining process are therefore extensively desired and it is one such mechanism that is disclosed herein.

SUMMARY OF THE INVENTION

Accordingly, it is the general purpose and object of the present invention to provide a distributed deflecting mechanism that disturbs excessive accumulation of larger particulates at each riffle of a dry washer that is kinetically driven by the mechanical agitation of the dry washer structure effecting the dry washing process itself Other objects of the invention are to provide a dry washer support assembly that is easily suspended at various inclinations to confine most of the energy utilized to the dry washing process itself, thereby optimizing the use of any portable power source carried to a remote site.

Yet additional and further objects of the invention shall become apparent upon the examination of the description following in association with the illustrations appended.

Briefly, these and other objects are accomplished within the present invention by way of a portable combination comprising a generally rectangular hopper open at its top to expose a classifying screen spaced above its bottom surface terminating in an end opening through which the classified particulates passed through the screen are conveyed into a rectangular dry washer housing resiliently suspended below the hopper while the larger particulates exceeding the screening size are simply dropped onto the adjacent ground. To effect this selective separation of the classified hopper outputs a portable frame assembly is deployed at the prospected site to support the hopper at an inclination draining its classified contents into the dry washer elastically suspended within the frame below it, at an oppositely inclined alignment so that the classified particulates that slide out the hopper end fall onto the highest part of a fibrous mat supported on a perforated diffuser panel spanning above the bottom surface of the washer housing to define a lower cavity into which the air flow from a portable blower is conveyed through an unbalanced fan. In this manner a single powered blower provides both the more robust mechanical agitation resulting from the rotary unbalance to move around the higher density particulates while also producing the various air flows that blow away the unwanted, less dense dust.

Those skilled in the art will appreciate that the above described agitation process relies extensively on particulate movements that result in all sorts of frictional losses between the particles themselves. Simply, as the particulates descend down the dry washer assembly the contacts between them, and with the washer structure, cause further fracturing to a point where their surface area-to-mass ratios within the air flow streams takes over to sort the particulates according to their relative density. Of course, these numerous impacts are also the ones that consume the local power, and the process, therefore, is inherently limited by the size and fuel consumption of the power source carried to the remote site. Thus the inherent remoteness of the available prospecting sites compel structural arrangements in which only the parts comprising the dry washer assembly are the main components agitated, with little parasitic power lost to frictional contacts within the hopper assembly.

To further enhance the efficient use of the locally carried power, and in particular, to enhance the differentiation between those lighter fine particulates that are to be carried away by airflow from the denser fine particulates that are descending down the dry washer and in the course of this gravity and agitation driven descent migrate downward into and through the fiber mat by their greater relative mass, the inventive structure is further provided with a generally rectangular riffle frame dimensioned for a removable mating fit on top of the fibrous mat to confine the mat in its deployed position within the washer housing on the spaced and perforated diffuser plate. This conforming riffle frame is provided with a plurality of transverse riffles of varying height, each spanning between the frame side members, with a substantial majority of these spanning riffles formed as a stepped section defined by a Z-shaped sectional form in which the leading edge, i.e., the edge that is aligned to oppose the gravitational descent of the particulates, extends as a cantilevered transverse strip spaced from the mat surface to form an upstream facing transverse cavity with the trailing edge also formed as a transverse strip that rests directly on the descending portion of the inclined mat below it, the leading and trailing strips being joined by an inclined surface slanted downward towards the trailing strip in the direction of the particulate descent. In this form the sectional shape of each riffle approximates a reversed sectional orientation of what was generally known as a 'Hungarian riffle' which, however, is used in the more robust fluid flow hydrodynamics of a stream sluice, flow dynamics that can effectively form a vortex trap behind the raised trailing riffle edge, with the water currents in the vortices sufficient to effectively move the denser particulates into trapping voids.

Unlike a water current, the forces in an aerodynamic flow scale generally as the density ratio of air to the density of water, a very large ratio, and the primary mechanism for moving the denser particulates in a dry washer is therefore, of necessity, the kinematics of agitation with the air flows then used to blow away the much lighter particulates. Agitation, however, also sets off the several modes of motion of each of the structural components of the assembly which are then utilized to produce the smaller particulates of which the denser ones are then further agitated while the lighter ones are blown away by the air flow passing through the interstices in the larger particle lattice. This random inter-particle collision process, however, provides a preference for frictional energy dissipation of the lower frequency modes of structural motion, leaving the higher frequency driving modes to persist in their agitation of the smaller particulates that by their mass-to-surface area ratios are more responsive to density separation by air flow and it is this separation preference that is inventively enhanced by a reversed Hungarian riffle alignment.

Thus the resilient suspension and the reversed riffle shape confine the whole of the agitation process that is inherently beset by large energy losses as result of the frictional contact of the particulates with the panel structures on which they slide down in the course of their descent, and even more so in the course of the inter-particulate impacts which help in the desired particle fracturing that improves their separation by specific density. Of course, those parts of this structure strengthened by panel corners, attachment seams, the transverse riffles and the like are particularly less prone to flex and shake, thereby promoting accumulation of particulates thereon which, like in the engineering school experiment noted above, defeat the beneficial effect of the raised and cantilevered leading riffle strip while also attenuating the elastic modes and slowing down the downward progression of the whole process.

In accordance with a further aspect of the present invention this unwanted accumulation of particulates is effectively eliminated by fixing the lower ends of a plurality of vertically aligned metal posts, or pins, at spaced intervals to the same leading edge strips of each of the riffles so that each such post extends in cantilever generally vertically therefrom to extend above the particulate flow and increase by their exposed cantilevered mass the elastic modes that are essentially undamped, while also deflecting laterally the larger particulates. The post spacings on each of the raised riffle strips may be laterally staggered along the direction of the particulate descent in order to fully expose the whole shaken particulate mass to agitation and air flow to promote the collection of the smaller and denser particulates within the fibers of the mat from where they either then fall through the diffuser plate perforations onto the washer bottom surface or are later shaken out when the mat is released from its captured state. In this manner the dissipation and the generation of the locally sourced agitation energy is effectively confined to the washer assembly itself in a manner that is maximized and enhanced by way of the spring-mass combinations mounted on each riffle that extend above the major damping effects of the passing particulates to reduce the power requirements to those accommodated in easily portable forms.

DESCRIPTION OF THE PREFERRED EMBODIMENT

Figure 1:
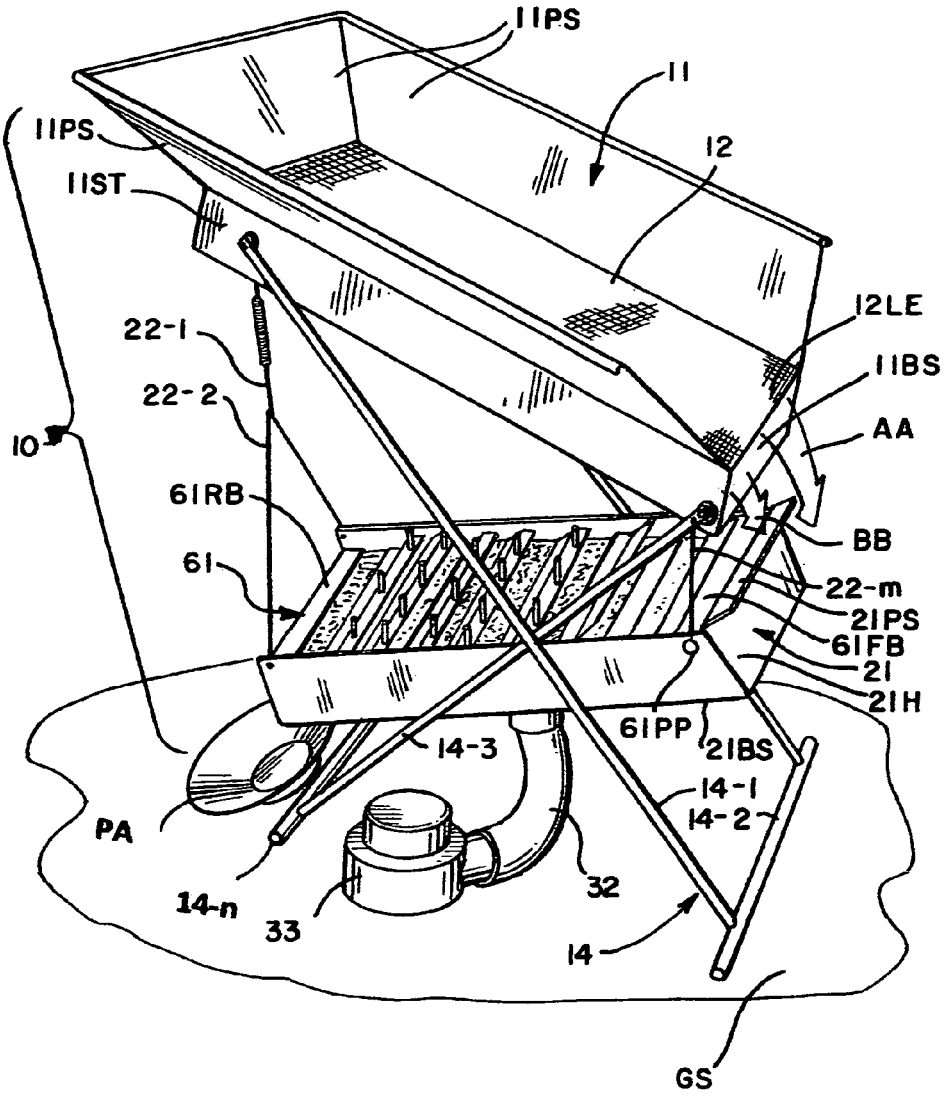
FIG. 1 is a perspective illustration of the inventive dry washer assembly in its fully deployed configuration at the prospected site.
Figure 2:
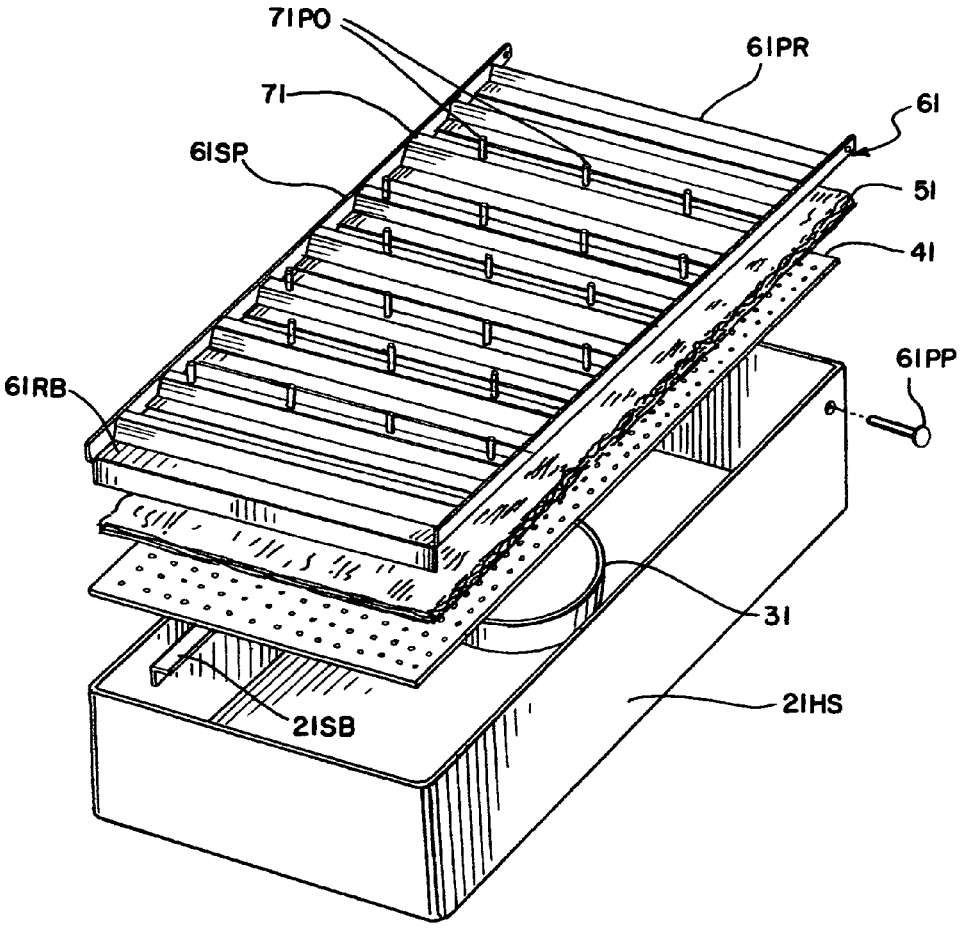
FIG. 2 is yet another perspective illustration of the inventive dry washer assembly, separated by its parts, illustrating the operative elements of the present invention.

As Shown in FIGS. 1 through 4 the inventive dry washer assembly, generally designated by the numeral 10, comprises a hopper 11 formed as a rectangular thin-walled structure 11ST open at its top and provided with a set of inclined panels 11PS extending outwardly from the periphery of its upper opening to guide whatever material is shoveled into its interior so that it slides down and falls onto a classifying screen 12 spaced from its bottom surface 11BS. An erectable support frame 14 comprising a plurality of tubular segments 14-1 through 14-*n* that are pinned to each other to form a generally triangulated assembly that is attachable at its upper ends to selected points on the hopper 11 provides an inclined supporting alignment for the hopper so that the particulates comprising the material shoveled into it are separated, or classified, by size according to the openings in the screen 12 with the larger particulates rolling down the screen 12 to fall over its lower edge 12LE onto the ground surface GS along the direction indicated by the arrow AA. The classified smaller particulates that pass through the screen 12, in turn, slide down the bottom surface 11BS of the hopper 11 to fall over its lower edge 11LE along the arrow BB into the upper opening of a dry washer assembly 21 resiliently suspended on suspension cables 22-1 through 22-*m* within the support frame 14 directly below hopper 11 with the receiving opening of the dry washer assembly 21, similar to the hopper 11, including an inclined shielding panel 21PS that guides these particulates into its interior in the course of this fall.

The dry washer assembly 21, itself, also includes a thin-walled, generally rectangular housing structure 21HS open at the top and including a bottom surface 21BS supporting a fan enclosure 31 communicating into the interior of housing 21HS the air conveyed through a hose 32 from a portable blower 33 to drive an unbalanced fan 31F mounted for air flow driven rotation that by its unbalance then induces agitating forces that shake the whole of the dry washer assembly 21, setting off the various elastic modes in each of the components thereof. The air flow AF, reduced in its intensity by the parasitic losses associated with the fan rotation, is then trapped within the lower part of housing 21HS by a dimensionally conforming diffuser plate 41 extending across the whole of the housing planform to pass through the plurality of diffusing openings 41DO in the plate into the interstices of a conforming fibrous mat 51 held in intimate contact on the diffuser plate 41 by a fitted riffle frame assembly 61 pivotally fixed by a set of pivot pins 61PP retaining its upper or front end adjacent the shielding panel 21PS that deflects the classified particulates falling from the hopper 11 into the dry washer assembly 21.

Figure 3:
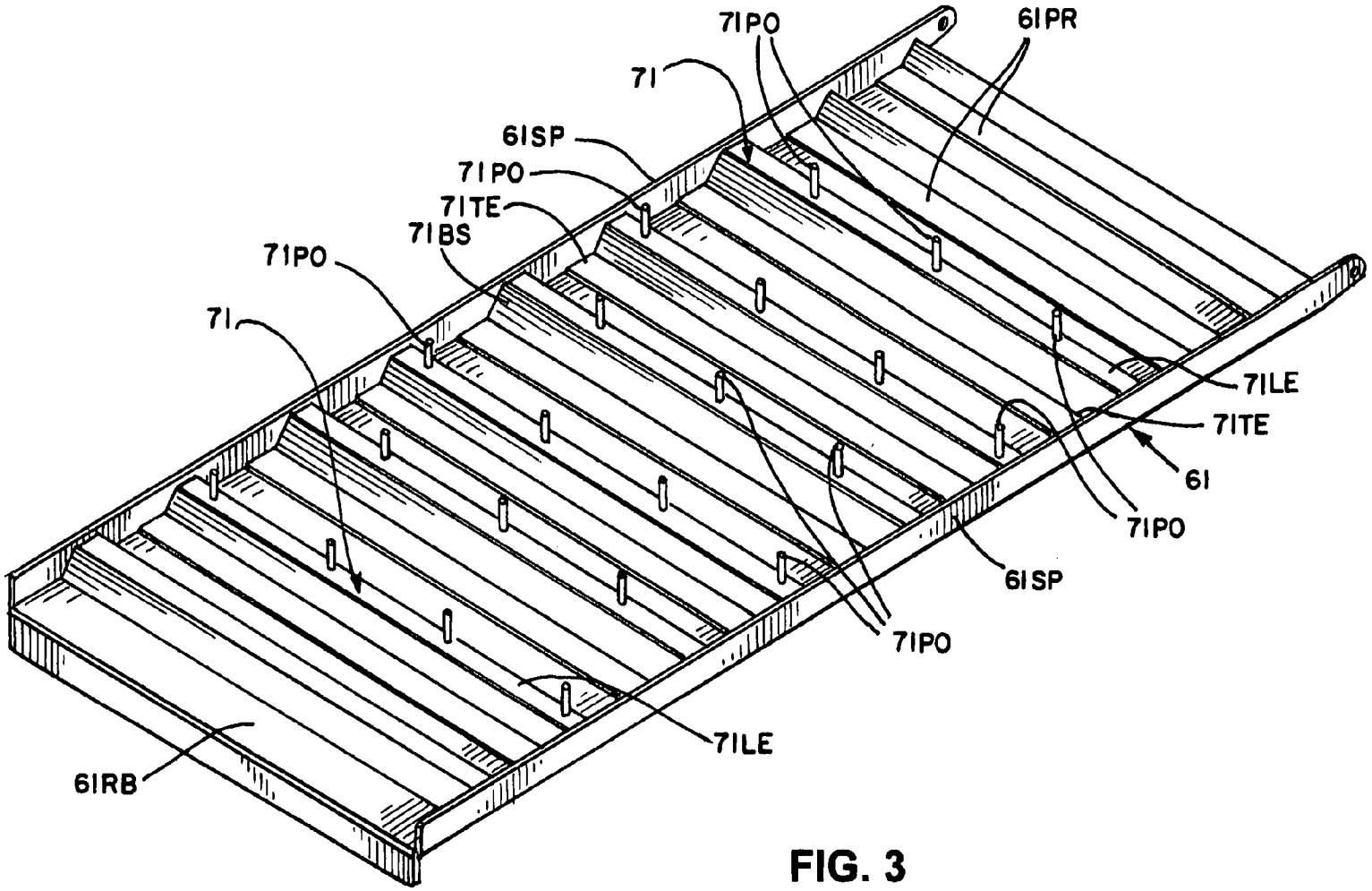
FIG. 3 is a further perspective illustration of a riffle frame in accordance with the present invention.
Figure 4:
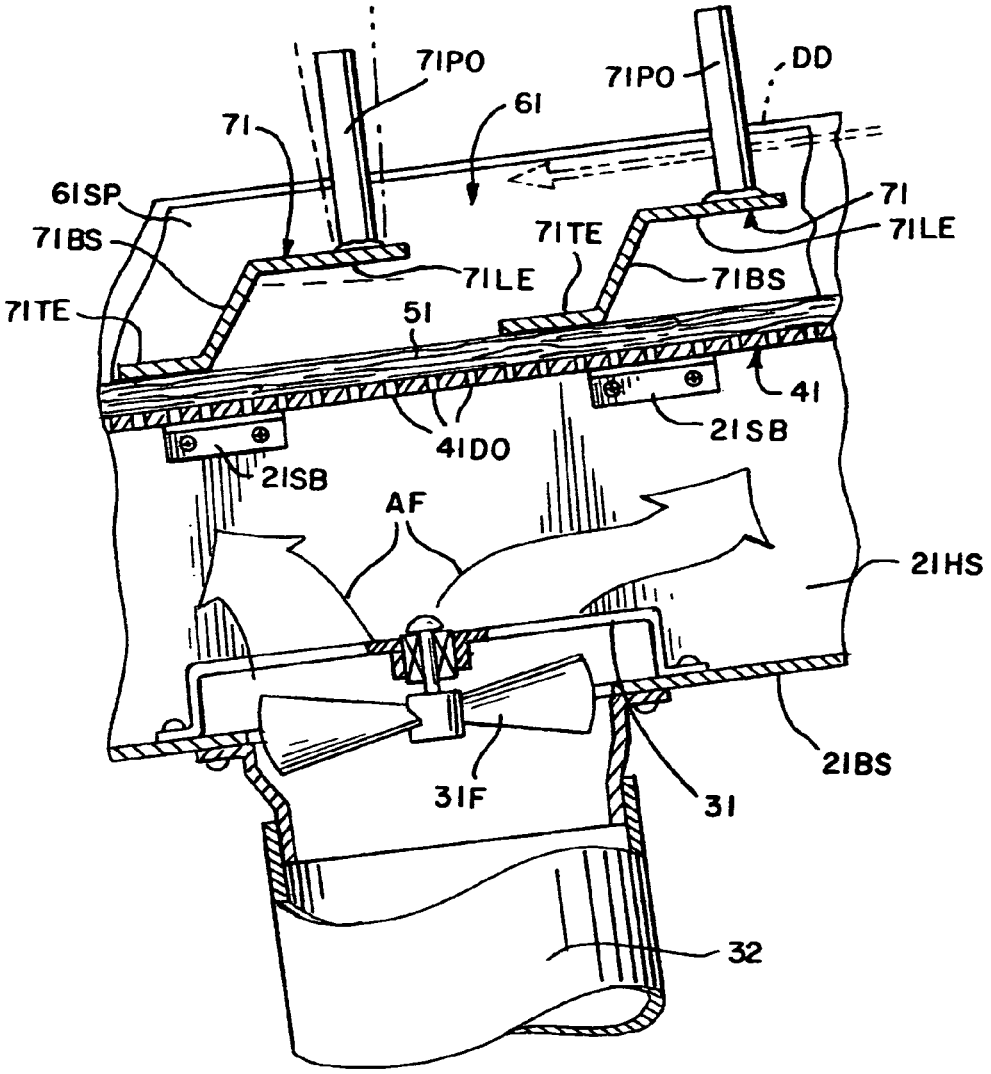
FIG. 4 is a sectional detail view depicting the use of vertical posts mounted in cantilever to extend from portions of a riffle structure to promote particulate separation and induced elastic modes therein in accordance with the present invention.

By particular reference to FIGS. 3 and 4, the riffle frame assembly 61 comprises two generally parallel, flat side pieces 61 SP in the form of metal straps spaced to face each other at a distance matching the interior width of the washer housing 21HS by way of welded attachments to the ends of a transversely spanning forward partial riffle 61PR and a rear end baffle 61RB, with the front ends of both side pieces perforated to engage the pivot pins 61PP while straddling a front baffle plate 61FB covering the front portion of the subjacent mat 51 so that all air flow escape out of the ends of the fibrous mat is prevented when the riffle assembly is fully seated thereon. Preferably, each of the side pieces 61SP are of a width selected to coincide with the top edges of the housing structure 21HS when resting on mat 51, a receiving depth determined by the placement of supporting brackets 21 SB within the housing structure on which the diffuser plate 41 is mounted, determining the depth for the descent progression of the particulate stream within the riffle frame assembly. Of course, this also determines the maximum useful depth of the particulate mass as it descends by gravity along the downwardly along the path shown by the double phantom descent vector DD in FIG. 4 to accommodate the further mounting of a plurality of inventive riffle structures 71 that include portions extending above this particulate flow to avoid what are often its supercritical damping. By limiting the particulate depth at each riffle location in the foregoing manner the elastic modes of motion of unrestrained riffle panels can then be utilized for their forcing impact downward on the denser particulates that may be trapped beneath them. Of course, the same riffle portions that extend above this friction inducing particulate mass also create trailing voids in the particulate flow through which the much lighter particulates are blown away, eliminating the burden of the unproductive particulates.

To achieve the foregoing effects each of the inventive riffles 71 is formed as an elongate segment fixed transversely in spaced increments between the side pieces 61 SP and convolved in the form of a stepped section defined by a trailing edge strip 71TE aligned for contiguous contact with the subjacent mat 51 and a generally parallel leading edge strip 71LE spaced at an offset from the trailing edge strip to extend in cantilever above the mat, the leading edge and trailing edge designations respectively corresponding to an alignment into and away from the path of the descending particulates as indicated by the vector DD. An inclined bridging surface portion 71BS extending between the leading and trailing edge strips then completes the riffle structure to form a transverse, forward facing cavity that opposes a substantial portion of the particulate descent driven by the agitation and the inclined washer alignment to approximate the stochastic processes sometimes referred to as 'random walk' or 'Markoff process' in mathematical modeling. Notably, the resulting forward facing cavities that are thus formed by each of the riffles approximate a rearward tapering wedge in which the elastic modes induced in the riffle structure assist in the downward progression of the denser particulates into the fibrous mat 51 and to obtain the effects set out above each of the leading edge strips 71LE supports a plurality of vertically projecting posts or pins 71PO that extend substantially above the particulate descent to minimize the attenuation of these elastic modes by friction while also opening ventilation pathways through the particulate mass through which the lighter particulates are blown away.

The benefits of the foregoing effects can be further extended by staggering the mounting locations of the posts 71PO on each of the successive riffles so that the whole of the descending particulate mass is exposed to the process. Moreover, by varying the vertical height of each of the leading edge strips 71LE the effects of any potential stratification in the particulate descent flow can be minimized, providing a convenient mechanism to resolve the occasional stochastic interlocks by the simple expedient of small dimensional variations in the several riffle structures.

The foregoing structural arrangement thus effectively conserves the levels of energy that need to be transported to the remote prospecting sites while also rendering convenient the periodic collection of the accumulated denser particulates by pivotally raising the riffle assembly 71 to remove the particulate laden mat 51 and shaking out its contents into a pan PA to be collected along with any particulates that may have migrated into the housing structure 21HS and then periodically processed in the conventional panning process, a sequence that may be repeated until the energy source is consumed. In this manner the inventive dry washer assembly effectively conserves both the manual burden of prospecting and also its efficacy in a structure that is simple, easily fabricated and fully adapted to the rugged settings of its use.

Obviously many modifications and variations of the instant invention can be effected without departing from the spirit of the teachings herein. It is therefore intended that the scope of the invention be determined solely by the claims appended hereto.

The invention claimed is:

1. A riffle assembly useful in separating the denser particulates from a particulate stream descending through an inclined agitated dry washer assembly, comprising:

a frame including a pair of substantially parallel side pieces dimensioned for conforming receipt within said dry washer assembly, each said side piece being connected to a respective end of a transversely aligned elongate riffle provided with a raised leading edge directed towards said particulate stream in a direction substantially opposite to the descent thereof through said washer and an opposingly directed trailing edge; and a plurality of posts mounted substantially orthogonally on said leading edge to project beyond said frame.

2. A riffle assembly according to claim 1, wherein:

said side pieces are each formed as opposingly facing, generally flat metal strips; and said respective ends of said riffle are attached by welding to the corresponding opposing face of said side pieces.

3. A riffle assembly according to claim 2, wherein:

said frame is receivable within said dry washer assembly at a depth exposing the ends of said posts.

4. A riffle assembly according to claim 3, wherein:

each said riffle is conformed for an elastic response to the imposition of a force thereto.

5. A riffle assembly according to claim 3, wherein:

said riffle assembly is conformed for an elastic response to the agitation of said dry washer assemply.

6. A riffle assembly receivable in an inclined dry washer assembly for separating the denser particulates from a particulate stream descending therethrough when agitated, comprising:

a frame including a pair of substantially parallel side pieces dimensioned for conforming receipt within said dry washer assembly, each said side piece being connected to a respective end of a transverse, generally elastic elongate riffle provided with a raised leading edge aligned to extend in cantilever into the descending progression of said particulate stream through said washer and an opposingly directed trailing edge; and a plurality of posts mounted substantially orthogonally on said leading edge to project above said frame.

7. A riffle assembly according to claim 6, wherein:

said side pieces are each formed as opposingly facing, generally flat metal strips insertable into said dry washer assembly to the full width thereof.

8. A riffle assembly according to claim 7, wherein:

said frame is receivable within said dry washer assembly at a depth exposing the free ends of said posts.

9. A riffle assembly according to claim 8, wherein:

each said riffle is conformed for an elastic response to the agitation of said dry washer assembly upon the receipt therein.

10. A riffle assembly according to claim 6, wherein:

each said riffle is conformed for an elastic response to the imposition of a force thereto.

11. A riffle assembly according to claim 6, wherein:

said riffle assembly is conformed for an elastic response to the agitation of said dry washer assemply.

12. In a dry washer assembly characterized by a generally hollow housing open at its top and suspended at an incline relative the horizontal for the application of agitating movements thereto, the improvement comprising:

a riffle assembly characterized by a frame defined by a pair of generally flat substantially parallel side pieces spaced for conforming receipt within said dry washer assembly, each said side piece being connected to a respective end of a transverse, generally elastic riffle provided with a raised leading edge aligned to extend in cantilever towards the upper part of said incline and an opposingly directed trailing edge; and a plurality of posts mounted substantially orthogonally on said leading edge to project above said frame.

13. A riffle assembly according to claim 12, wherein:

said side pieces are each formed as opposingly facing, generally flat metal strips insertable into said dry washer assembly to the full width thereof.

14. A riffle assembly according to claim 12, wherein:

said frame is receivable within said dry washer assembly at a depth exposing the free ends of said posts.

15. A riffle assembly according to claim 14, wherein:

each said riffle is conformed for an elastic response to the agitation of said dry washer assembly upon the receipt therein.

* * * * *